United States Patent [19]

Clokie

[11] 4,234,021

[45] Nov. 18, 1980

[54] CIRCULAR LOOMS

[75] Inventor: Andrew K. Clokie, Dewsbury, England

[73] Assignee: Greenbat Limited, Leeds, England

[21] Appl. No.: 971,522

[22] Filed: Dec. 20, 1978

[51] Int. Cl.[3] ..... D03D 51/40

[52] U.S. Cl. ..... 139/371

[58] Field of Search ..... 139/13 R, 336 R, 370.1, 139/371

[56] References Cited

U.S. PATENT DOCUMENTS

| | | | |
|---|---|---|---|
| 2,535,369 | 12/1950 | Pelce | 139/371 |
| 2,587,982 | 3/1952 | Dunod | 139/371 |
| 3,298,401 | 1/1967 | Stutz | 139/371 |
| 3,322,162 | 5/1967 | Rydborn | 139/371 |
| 4,031,924 | 6/1977 | Domig et al. | 139/371 |

FOREIGN PATENT DOCUMENTS

| | | | |
|---|---|---|---|
| 940121 | 4/1948 | France | 139/371 |

*Primary Examiner*—Henry Jaudon

*Attorney, Agent, or Firm*—W. Thad Adams, III

[57] ABSTRACT

In a circular loom a weft failure indicator system includes means for issuing a signal that a weft failure has occurred on the shuttle, and a detector adapted to detect the weft failure signal, the detector being located on a stationary part of the loom and adapted to receive signals at all positions around the path of the shuttle. This provides a more rapid response to weft failure than systems in which the signal is only detected once in every revolution of the shuttle.

The shuttle signal is a radio frequency signal and the detector a circular aerial.

8 Claims, 6 Drawing Figures

CIRCULAR LOOMS

When the weft issuing from a shuttle in a circular loom fails, either because the weft supply in the shuttle is exhausted, or because the weft thread being drawn out of the shuttle has broken, it is necessary to bring the loom to rest. For this purpose, a weft detection system has to be provided, and the problem is rather more difficult than that encountered in flat looms, because the shuttles are never stationary during normal operation of the loom, nor is it practicable to employ a weft fork mechanism, because in the circular loom there is no reciprocatory beat-up motion.

Weft failure detection systems have been proposed for circular looms, and in one of these, a displaceable flag is provided on the shuttle, displacement being effected by failure of the weft supply, the flag being adapted to reflect light from a stationary light source, on to a photo-electric detector, for the purpose of giving an indication that the weft supply has ceased. This particular system is subject to drawbacks, for example the light may be reflected from some other part of the loom, the shuttle, or the weft itself. Furthermore, all the known systems of weft failure detection in a circular loom rely upon a detector located at a discrete position around the circular path of the shuttles, and this means that the system does not provide a rapid response to weft failure. For instance, if weft failure occurs immediately after a shuttle has passed the detector, then the shuttles will continue to rotate through almost 360°, before the detector will signal that the weft supply has failed.

Since the shuttles will in any case continue to travel around their circular path after a weft failure has been signalled, due to the inertia of the moving parts, it is important that the detection system itself shall respond as rapidly as possible to failure of the weft, and it is the principal object of the present invention to provide a system which is adapted to produce a rapid response.

According to this invention, in a circular loom, there is a shuttle having means for issuing a weft failure signal, the loom having a detector adapted to sense that a a weft failure signal has been issued, the detector being located in a stationary fashion adjacent to the path of the shuttle and being so arranged that it is effective at all positions throughout substantially the whole circular path of the shuttle. Preferably, the detector includes a receiving element extending in substantially a complete circle around the axis about which the shuttle rotates in the loom.

The detector is preferably arranged to control a function of the loom in accordance with its state of excitation, and in the preferred arrangement, the detector is arranged to maintain the loom in motion if it is not excited by the weft failure signal, but to cause the loom to be stopped if it is excited due to the issuing of a weft failure signal by the shuttle.

According to another preferred feature of the invention, the means for issuing a weft failure signal includes a radio frequency transmitter and the detector includes a radio frequency receiver adapted to be excited by signals from the transmitter. In that case, the detector may comprise an aerial. It will be appreciated, that there is always a problem in transferring a signal that a weft failure has occurred from the rotating shuttle, to the stationary parts of the loom, and a radio frequency transmitter provides a particularly effective method of transmitting the signal. Because the aerial can be arranged on the loom closely adjacent to the path of travel of the shuttles, the transmitter in the shuttle can have a low power, so that it is unlikely to produce interference problems.

As an alternative to the radio frequency transmitter, the means for issuing a weft failure signal may include an ultra-sonic transmission device.

According to another preferred feature of the invention, there are means on the shuttle for generating a d.c. supply voltage proportional to the angular velocity of a rotatable weft package in the shuttle, and apparatus for sensing a decrease in the supply voltage and for issuing a weft failure signal in response to sensed decrease in the supply voltage. In one arrangement, there is a generator in the shuttle, the generator having a driving member adapted to rotate with the generator rotor, the driving member being further adapted to frictionally engage with a weft carrier when the latter is mounted in the shuttle, so that rotation of the weft carrier produces a rotation of the driving member. Preferably there is a pair of axially aligned rotary mountings on which the ends of a tubular weft carrier can be received as a means of mounting the weft carrier for rotation in the shuttle. It is further preferred, to provide a rectifier arranged to convert the alternating current produced by the generator into a direct current which is supplied to the apparatus for sensing a decrease in the supply voltage.

According to yet another preferred feature of the invention, the sensing apparatus comprises first and second capacitors arranged in parallel across said supply voltage, with a stand-off voltage system arranged between them, so that the second capacitor will be at a lower potential than the first capacitor, due to the stand-off effect, so long as the supply voltage is constant or rising, and a transistor also connected between the two capacitors, in such a manner that it is in a non-conducting state so long as the voltage across the second capacitor remains lower than that across the first capacitor, but will conduct and discharge the second capacitor through a sensing part of the apparatus if the voltage across the second capacitor exceeds that across the first capacitor. The stand-off voltage system may comprise a diode arranged to permit current flow from the first capacitor to the second capacitor, but to inhibit current flow from the second capacitor to the first capacitor.

According to another preferred feature, the base of the transistor is connected to the first capacitor side of the diode and the emitter to the second capacitor side of the diode, the collector being connected to the sensing part of the apparatus. The sensing part of the apparatus may comprise a resistor, an inductance coil or any other electrically responsive component or combination of components. There may be one or more additional diodes in series with the first diode to increase the stand-off ratio between the voltages at the first and second capacitors.

A circular loom incorporating the invention, and its method of operation, will now be described by way of example only, with reference to the accompanying drawings, in which.

Figure 1:
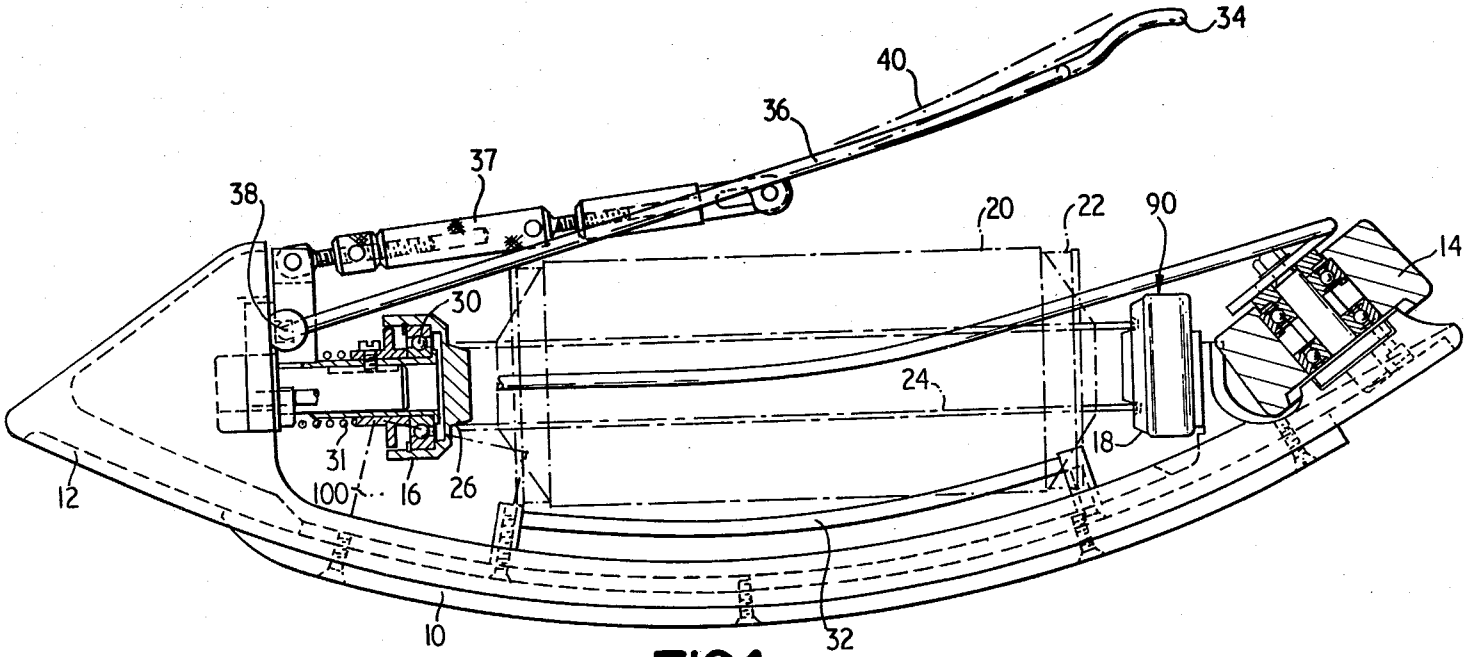
FIG. 1 is a plan view of a circular loom shuttle.
Figure 2:
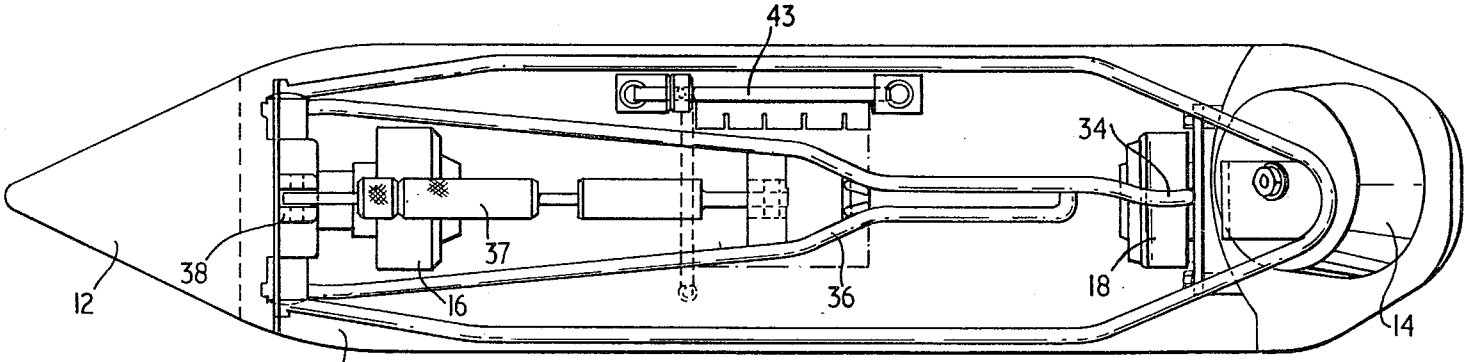
FIG. 2 is a side elevation of the shuttle shown in FIG. 1.

The loom itself is generally of conventional construction, that is to say it has a stationary framework supporting the shedding mechanism, and a circular track, on which the shuttles rotate about a vertical axis. In FIGS. 1 and 2, there is shown a shuttle which is also of generally known construction intended to be used in the loom. It will be appreciated by those skilled in the art, that a plurality of such shuttles is arranged in the loom, in this particular instance four, and that each shuttle travels in its own travelling shed of warp threads, as the main driving shaft (not shown) of the loom is rotated. The four shuttles in this particular arrangement are arranged at 90° intervals around the vertical axis of the loom.

Each shuttle has a body 10, which as seen in FIG. 1, is generally arcuate, following the curvature of the track (not shown) on which the shuttle has to run in the loom. The nose 12 of the shuttle is pointed, to ease the passage of the shuttle through the warp threads as they open in front of the shuttle, and at the rear end of the shuttle there is a freely rotatable roller 14, which engages with a driving member (not shown) whereby the shuttle is propelled around its circular path. Incorporated in the shuttle construction are front and rear yarn package mounting members 16 and 18, adapted to receive a yarn package between them. As indicated by the chain-dotted lines in FIG. 1, the weft package itself may be a parallel package 22, in which case there are disc flanges at each end of the weft, or it may be a taper end package 20, in which case no end flanges are required. In any case however, the weft package will have a central tube 24, the ends of which are received on frusto-conical portions 26 and 28 respectively of the package mounting members 16 and 18. The latter are free to rotate on journal bearings, one of which is shown at 30 in FIG. 1, and while the mounting 18 is axially fixed, the mounting 16 is axially movable and is loaded by a spring 31 towards the mounting 18, so that the tube 24 of a package 20 or 22 can only be fitted into the shuttle, by forcing the mounting 16 forwardly against the action of the spring 31, and when the mounting 16 is allowed to return under its spring loading towards the rear, it presses its frusto-conical portion 26 into the front end of the tube 24 and forces the rear end of the tube 24 into frictional engagement with the frusto-conical portion 28 of the mounting member 18. In this way, the weft package is held by friction between the two mounting members, and the weft package is then free to rotate about its own longitudinal axis by virtue of the journal bearing mounting of the mounting members 16 and 18.

An arcuate rail 32 is provided within the shuttle body, and the weft drawn off the package 20 or 22 is first carried around the outside of the rail 32, and then passes inwardly towards a weft guiding arrangement 34 at the free end of a boom 36, which is pivoted on the shuttle body 10 at 38. The boom 36 is held by an adjustable length strut 37 in an inclined position as illustrated in FIG. 1, where its free end runs on a vertical tube 40 (forming part of the loom) over which the woven fabric is formed during the weaving process. It is possible to employ tubes 40 or differing diameters according to the diameter of fabric "tube" which is to be produced, but changes in the tube diameter can be accommodated by varying the length of the strut 37 and hence the angle of inclination of the boom 36.

As the shuttle travels around the loom, weft is payed out from the weft package 20 or 22 in the shuttle, this weft being drawn into the fell of the cloth, which is being formed to the rear of the shuttle. The weft package 20 or 22 is caused to rotate about its longitudinal axis by the tension in the weft which is being drawn off that package, and because the weft package itself rotates, no twist is inserted into or taken out of the weft yarn as a result of the release of the weft from the shuttle. This method of withdrawing the weft from the shuttle is of advantage where flat tape weft is being used as in the case of sack production using flat polypropylene tape for both the warp and weft. However, the fact that the weft package and its mountings 16 and 18 rotate is made use of in the present invention.

Figure 3:
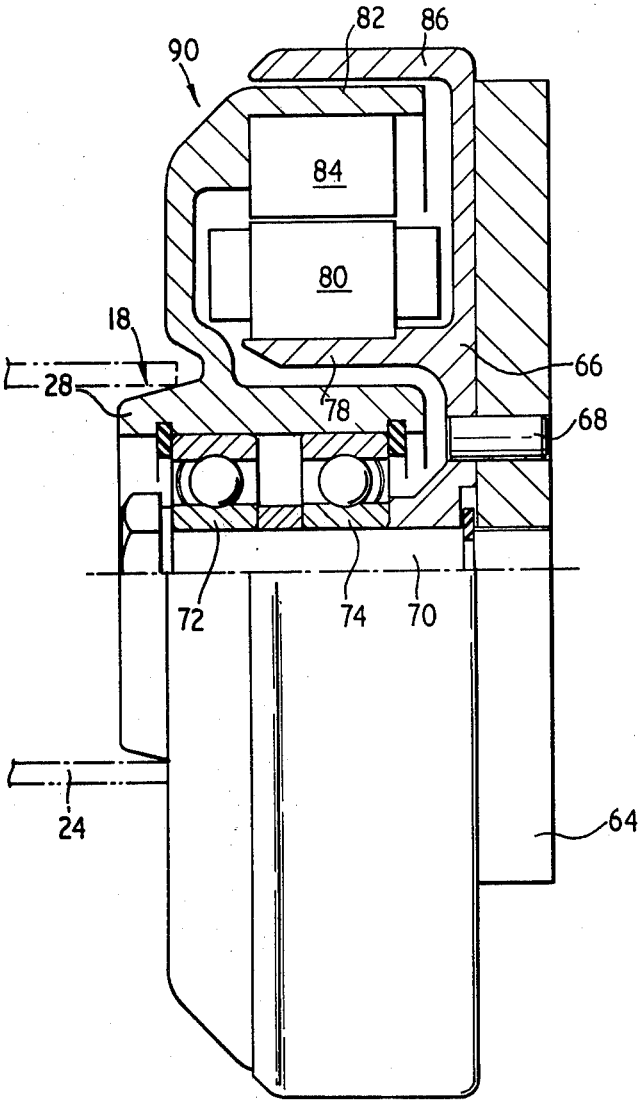
FIG. 3 is a section through a generator, used in the shuttle shown in FIGS. 1 and 2.

The mounting member 18 is formed as the rotor of a small electric generator indicated generally at 90, and illustrated in detail in FIG. 3. A mounting plate 64 is secured to the shuttle body 10, and a stator 66 is fastened to the plate 64 by a pin 68. An axle 70 is also fastened to the plate 64 and provides a mounting for a pair of journal bearings 72 and 74 on which the mounting member 18 is rotatably mounted. An annular boss 78 formed on the stator carries stator windings 80 of the generator. An annular flange 82 on the mounting member 18 surrounds the stator windings 80, and a plurality of permanent magnets 84 is secured to the inside of the this flange, to provide the rotor of the generator. A very compact electrical generator is thus formed, in which the mounting member 18, with its frusto-conical portion 28 for the reception of the weft package tube 24, provides the rotor.

The stator 66 also has an annular shroud 86 closely surrounding the flange 82 of the rotor. This shroud prevents yarn being trapped between the rotor and stator, because the entrance to the gap between the rotor and stator is in an end face rather than in a peripheral face. It will be observed that the shroud 86 and the end of the mounting member 18 are bevelled to a common part-conical surface which also deters the entrance of yarn between the rotor and stator.

So long as the weft package is rotating due to yarn being drawn off from it, an electrical current will be generated by rotation of the mounting member 18. However, if the weft supply on the package 20 or 22 becomes exhausted, or the weft yarn being drawn off the package breaks, then the tube 24 will cease its rotation, and the generator which includes the rotor formed by the mounting 18 will cease to generate a current. The apparatus which is fitted on the loom, makes use of the difference between the presence or absence of an electrical current generated by the rotation of the mounting 18, to indicate whether or not weft is being drawn off the weft package. It will be appreciated however, that the inertia of the weft package mounting arrangement will produce some over-run of the mounting 18 (and therefore generation of a current) after the yarn has failed. The present arrangement however provides apparatus for detecting almost immediately when there is a yarn failure. It will be appreciated, that weft is drawn into the woven fabric at a constant linear velocity, but that as the weft is withdrawn from the yarn package, the radius at which it is leaving the package is constantly reducing. Hence, the angular velocity of the tube 24, and therefore that of the rotor of the generator is constantly increasing throughout the period during which weft is being supplied from the yarn package.

Thus, the value dv/dt (where v is the angular velocity of the tube 24) is positive.

A rectifier 92 (see FIG. 5) is also provided on the shuttle, and as indicated diagrammatically in that figure, the electrical potential produced by the generator 90, which will have a sinusoidal wave form, is applied to the rectifier 92, which converts the input voltage to a d.c. voltage output. This output voltage will be constantly increasing due to the increasing angular velocity (v) of the rotor of the generator. In other words, the output voltage (V) of the rectifier 92 can be regarded as directly proportional to the angular velocity (v) of the tube 24. The generator 90 therefore provides a means of producing a voltage which is substantially directly proportional to the angular velocity of the moving part, that is the tube 24 of the yarn package.

A small flat radio frequency transmitter 100, shown in chain-dotted lines in FIG. 1, is fixed inside the nose end of the shuttle, and the output from the rectifier 92 is applied to this transmitter, via a diode 101. The rectifier 92 and diode 101 are in fact contained in the same housing as the transmitter 100. The transmitter 100 is adapted to produce an output signal in the radio frequency band, and in this specific example, it has an output of 130 kHz. The electrical system of the shuttle is arranged so that the strength of the generated radio frequency emission is only effective within a range of a few centimeters.

Figure 5:
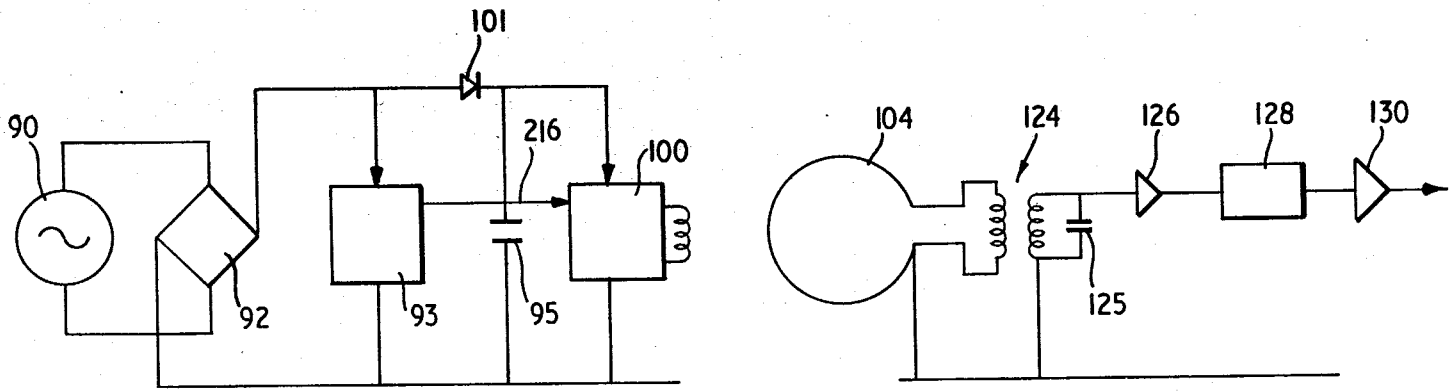
FIG. 5 is a block diagram illustrating the weft detection system.
Figure 6:
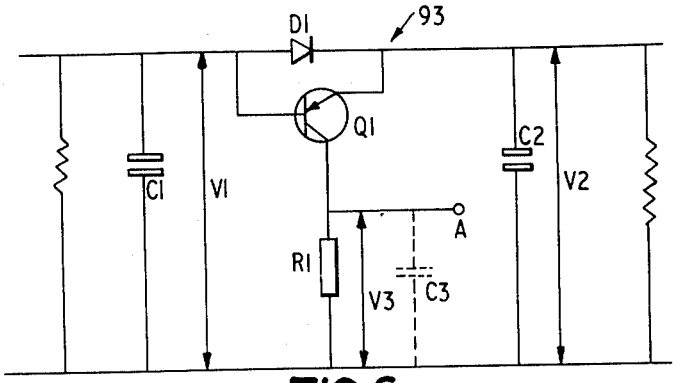
FIG. 6 is a diagram of a deceleration detector circuit.

Referring to FIG. 5, it will be seen that the output from the rectifier 92, is also applied to a deceleration detector apparatus 93, which, is illustrated in detail in FIG. 6. The deceleration detection apparatus 93 is also housed within the same casing as the transmitter 100. First and second capacitors C1,C2 are arranged in parallel across the d.c. supply from the rectifier 92, and a diode D1 is arranged between the two capacitors. A transistor Q1 is shunted across the diode D1 and a resistor R1 is connected to the emitter of the transistor Q1.

The supply voltage V1 is applied across the first capacitor C1, and this voltage V1 changes rapidly in sympathy with the applied voltage—that is the voltage proportional to the angular velocity of the weft package. At the same time, the capacitor C2 is charged at a similar rate, via the diode D1, but it only reaches a voltage V2, which is inherently lower than the voltage V1, due to the intrinsic stand-off voltage across D1. Because of this difference in the voltages V1 and V2, the transistor Q1 will be forced into a non-conducting state, due to the base/emitter junction being reverse biased. This situation will continue so long as the voltage V1 is rising or is steady, and as has previously been described, this voltage should be continuously rising throughout the period that weft is being drawn off the yarn package.

Supposing that there is a failure in the weft, so that the tube 24 and the rotor of the generator only continue to rotate by virtue of their inertia, then immediately, the voltage V1 will begin to drop, and as soon as the voltage V1 becomes less than the voltage V2, the base/emitter of the transistor Q1 will become positively biased, and the transistor will start to conduct, discharging the second capacitor C2, through the resistor R1, and causing a voltage to appear at an output A.

The output at A is taken via a lead 216 (see FIG. 5) to the transmitter 100, and is arranged to gate the transmitter 100, so that the latter will only emit a radio frequency signal when a signal appears at the output A of the deceleration detector circuit 93. Now it will be appreciated, that the reaction of the electrical detection system illustrated in FIG. 6 is very rapid, so that the emission from the transmitter 100, will occur, almost immediately when there is a failure of the weft supply. Consequently, the response time of the entire weft failure detection system is very much reduced, and of course this is of advantage, since it reduces the length of fabric in which there is an absence of weft yarn.

Since the fall in the voltage V1 may be quite small, the voltage V2 will rapidly fall below the voltage V1, and once it has reached a level below that of V1, the transistor Q1 is immediately turned off, and the signal ceases to appear at the output A. However, if the voltage V1 continues to decrease (as it will do in the case of a decelerating generator) the condition will be again arrived at where the voltage V1 is less than the voltage V2, at which point the transistor Q1 will again begin to discharge the capacitor C2. Consequently, the output at A will appear as a series of pulses. Since this may be undesirable, it is possible to introduce a third capacitor, shown at C3 in FIG. 6, which provides integration of the pulses across the resistor R1, giving a continuous output at A.

The sensitivity of the circuit shown in FIG. 6, can be altered by inserting additional diodes in series with the diode D1, thereby alterting the stand-off ratio between the voltages V1 and V2. In other words, due to the additional diodes, the capacitor C2 will charge to an even lower potential than the capacitor C1, and therefore the voltage V1 will have to fall farther, before the transistor Q1 is switched on to discharge the transistor C2.

Since the circuit shown in FIG. 6 relies upon the discharge of the second capacitor C2 to obtain an impulse from the transistor Q1, the circuit is not reversible to give pulses on acceleration of the generator. This is because, in acceleration, the voltage V2 has to remain lower than the voltage V1, and therefore the circuit must become a capacitor charge circuit, which is an entirely different configuration.

Figure 4:
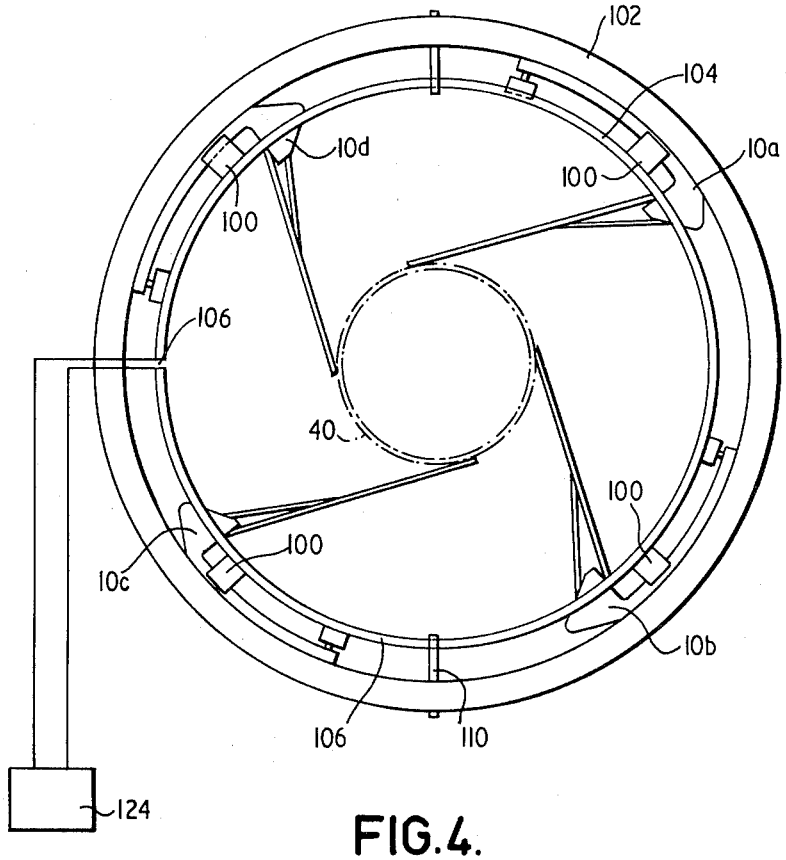
FIG. 4 is a diagrammatic plan view of the loom.

Turning now to FIGS. 4 and 5, it will be appreciated that only a few elements of the loom are illustrated, sufficient for an understanding of the operation of the invention. The tube 40 and the reed retaining ring 102 which are concentric and stationary are shown in FIG. 5. The reed retaining ring is located a short distance above the top end of the tube 40. The warp yarns pass over the reed retaining ring from the outside, and then travel radially inwards to the top of the tube 40. Four shuttles 10*a*, 10*b*, 10*c* and 10*d* are provided in the loom, and these are arranged to travel in a circular path about the vertical axis of the loom, the shuttles being disposed in the annular region between the ring 102 and the tube 40. The warp threads in the said annular region are divided into four travelling sheds, one for each shuttle, by the loom shedding motion (not shown). This arrangement of the shuttles in the loom is conventional, and has only been described in order to set out the environment of the invention.

A radio pick-up aerial 104 is provided, this aerial being formed into almost a complete circle, with only a small gap 106 between its ends. The radius of the aerial is smaller than the inside radius of the reed retaining ring 102, but the aerial is within the depth of the ring 102, and the annular gap between the inside of the ring 102 and the aerial 104 is approximately 25 millimeters wide in the particular loom which is being described. Moreover, the arrangement is such that each of the transmitters 100 lies underneath this annular space when the shuttles are in their operative locations in the loom. As is indicated in FIG. 4, each of the transmitters bridges the annular gap as seen from above, but in fact the shuttles are located below the ring 102 and hence below the aerial 104, but the aerial is well within the range of the transmitters 100.

The ends of the aerial 104 are connected as illustrated in FIG. 5, to a tuned circuit 124, which essentially comprises a transformer. A capacitor 125 is arranged in parallel with the secondary of the tuned circuit 124, for the purpose of smoothing out the output signals from the tuned circuit.

The output from the tuned circuit is applied to an integrated circuit detector 126, and to a pulse stretcher circuit of known construction. The output signal from the pulse stretcher is taken to a control circuit 130 which is arranged, so that when it is activated, it disconnects the electrical supply to the loom driving motor, and hence brings the loom to rest.

The overall operation of the weft failure detection system will now be described.

So long as each of the four shuttles 10*a*, 10*b*, 10*c* and 10*d* contains an adequate weft supply, and that weft is being drawn off, the generator 90 of each shuttle will be generating an output current. However, the deceleration detector circuit 93 will sense that the angular velocity of the tube 24 on which the weft is wound, is either constant or increasing in value, and hence will not give an output signal, thereby allowing the transmitter 100 to remain in a quiescent state. Hence, no signals are detected by the aerial 104, and the loom will continue to run.

As soon as the weft from any one shuttle fails either because of exhaustion of the weft supply, or because the weft thread has broken, there will be an immediate deceleration of the tube 24, and this will produce a corresponding decrease in the output voltage from the generator 90. This reduction in voltage will be immediately detected by the deceleration detector circuit 93, which will activate the transmitter 100. So long as there is an output signal from the circuit 93, a radio frequency signal will appear at the transmitter 100 of that shuttle in which there is a failure of weft supply. Consequently, the aerial 104 will pick up the transmitted signal, and it is a significant feature of the invention, that this pick up will occur, no matter what the position of the shuttle at the time when the weft failure occurs.

On detection of a signal by the aerial 104, an output signal appears at the output circuit 130, the pulse stretcher 128 being effective to ensure that the signal at the output circuit 130 is sufficiently long to activate that circuit, even if the signal received by the aerial 104 is extremely short. This provides that the detection system is extremely sensitive, which consequently ensures a rapid response of the overall weft failure detection system. When the output circuit is activated, the driving motor of the loom is switched off, and consequently the loom is brought to rest.

The arrangement described above in relation to the drawings, presents a very effective method of bringing the circular loom to rest on failure of the weft supply from any one of its shuttles. It meets the problem of transferring a signal from the continuously moving shuttles to the stationary parts of the loom by use of a transmitter, and it uses the actual withdrawal of the weft yarn as a method of generating the radio frequency signal. Moreover, the arrangement of the aerial 104 ensures virtually constant monitoring of the weft supply from each of the four shuttles, avoiding the necessity for more complex arrangements, where the monitoring only occurs at certain times in a cycle of the loom.

It is to be understood, that instead of the radio frequency transmitter 100, there could be an ultra-sonic transmission device powered by the generator and gated by the deceleration detection means in the same manner as the radio frequency transmitter. In that case, an appropriate ultra-sonic detector would be used in place of the aerial 104. That detector however could be mounted in a central position on the loom above the shuttle track, so that it could receive a signal from any one of the transmission devices.

In the arrangement described above, there is a single aerial forming almost a complete circle around the path of the shuttles. In an alternative arrangement, there are a plurality of arcuate aerials arranged end-to-end, so that together they form a complete circle. Each arcuate aerial can pick up a signal from whichever shuttle is passing it, and in this way there is continuous monitoring of all the weft supply from all the shuttles. With this arrangement, it is possible to dispense with the deceleration detection means and to produce a continuous output from each transmitter 100 so long as weft is being payed out. The signals picked up by the four aerials are fed to a logic circuit arranged to give an output which will initiate stoppage of the loom if the signal from any one shuttle ceases.

I claim:

1. A circular loom, comprising a plurality of shuttles each adapted to traverse the same circular path in the loom, and each having a radio frequency transmitter adapted to issue a weft failure signal, said loom having a radio frequency detector located in a stationary position adjacent to the circular path of said shuttles and being adapted to be excited by a signal from any one of said transmitters, whereby weft failure in any one of said shuttles can be detected without physical contact between parts extending through the warp threads of said circular loom.

2. A circular loom according to claim 1, wherein said detector includes an aerial extending in substantially a complete circle around the axis about which said shuttle rotates in said loom.

3. A circular loom according to claim 1, wherein said detector is arranged to maintain said loom in motion if it is not excited by the weft failure signal, but to cause said loom to be stopped if it is excited due to the issuing of a weft failure signal by said shuttle.

4. A circular loom according to claim 1, wherein there are means on said shuttle for generating a d.c. supply voltage proportional to the angular velocity of a rotatable weft package in the shuttle, and apparatus for sensing a decrease in said supply voltage and for issuing said radio frequency in response to a sensed decrease in said supply voltage.

5. A circular loom according to claim 4, wherein there is a generator in said shuttle, said generator having a driving member adapted to rotate with the generator rotor, said driving member being further adapted to frictionally engage with a weft carrier when the latter is mounted in said shuttle, so that rotation of said weft carrier produces rotation of said driving member.

6. A circular loom according to claim 4, wherein the sensing apparatus comprises: first and second capacitors arranged in parallel across said supply voltage; a standoff voltage system arranged between said first and second capacitors, so that said second capacitor will be at a lower potential than said first capacitor, due to the stand-off effect, so long as said supply voltage is constant or rising; a transistor also connected between said two capacitors, so that it is in a non-conducting state so long as the voltage across said second capacitor remains lower than that across said first capacitor, but will conduct and discharge said second capacitor if the voltage across said second capacitor exceeds that across said first capacitor, and a sensing part through which said second capacitor can be discharged.

7. A circular loom according to claim 6, wherein said stand-off voltage system comprises a diode arranged to permit current flow from said first capacitor to said second capacitor, but to inhibit current flow from said second capacitor to said first capacitor.

8. A circular loom according to claim 7, wherein base of said transistor is connected to said first capacitor side of said diode and the emitter to said second capacitor side of said diode, the collector being connected to said sensing part of the apparatus.

* * * * *